US012116907B1

(12) United States Patent
Doupis et al.

(10) Patent No.: US 12,116,907 B1
(45) Date of Patent: Oct. 15, 2024

(54) STEAM DISCHARGE PIPE BLOWBACK PROTECTION SYSTEM

(71) Applicant: GENERAL ELECTRIC COMPANY, Schenectady, NY (US)

(72) Inventors: Dimitrios V. Doupis, Windsor, CT (US); Denis Bruno, Windsor, CT (US); Steven Kurdziel, Windsor, CT (US); Stewart Wyatt, Windsor, CT (US); Carmen Joseph Marrone, Windsor, CT (US); Hugo Enrique Soto Barragan, Queretaro (MX)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 18/323,711

(22) Filed: May 25, 2023

(51) Int. Cl.
*F01K 23/02* (2006.01)
*F01K 13/02* (2006.01)
*F01K 23/10* (2006.01)

(52) U.S. Cl.
CPC ..... *F01K 23/101* (2013.01); *F01K 13/02* (2013.01)

(58) Field of Classification Search
CPC ..... F22B 37/44; F22B 37/36; F22B 37/24
See application file for complete search history.

(56) References Cited

U.S. PATENT DOCUMENTS 4,416,581 A * 11/1983 Geary, Jr. ..... F01D 5/087 415/115
4,493,608 A * 1/1985 Paul ..... F04D 27/0207 415/17
2018/0163573 A1* 6/2018 Dang ..... F01K 23/10
2019/0170021 A1 6/2019 Magee et al.
2020/0056510 A1* 2/2020 Magee ..... F01K 7/38
2021/0088000 A1 3/2021 Doupis et al.

FOREIGN PATENT DOCUMENTS

JP S5597574 A * 7/1980 ..... F16K 17/00
KR 200323381 Y1 * 8/2003 ..... F16K 17/00

OTHER PUBLICATIONS

English Translation KR200323381Y1 (Year: 2003).*
English Translation JPS5597574A (Year: 1980).*

* cited by examiner

*Primary Examiner* — Shafiq Mian
(74) *Attorney, Agent, or Firm* — Eversheds Sutherland (US) LLP

(57) ABSTRACT

The present application provides a steam discharge pipe blowback protection system for use with a steam discharge pipe and a flow of steam therethrough. The steam discharge pipe blowback protection system may include a vent stack pipe and a drip pan with an exit end of the steam discharge pipe extending through the drip pan and into the vent stack pipe. The drip pan includes a slide plate positioned around the steam discharge pipe such that a blowback in the flow of steam causes the slide plate to seal the drip pan.

17 Claims, 5 Drawing Sheets

STEAM DISCHARGE PIPE BLOWBACK PROTECTION SYSTEM

TECHNICAL FIELD

The present application and the resultant patent relate generally to combined cycle power systems and more particularly relate to a steam discharge pipe blowback protection system to accommodate steam blowback as well as eccentricity in the discharge piping due to thermal growth at startup until equilibrium is reached.

BACKGROUND

Power systems typically include a number of different turbomachines that are used to generate power output. Conventional combined cycle power plants use one or more gas turbine systems operatively coupled to one or more steam turbine systems. The gas turbine system includes a compressor coupled to an expansion (gas) turbine. The expansion turbine is usually coupled to and drives an external component, such as a generator, for producing a load or power output. The steam turbine system generally includes a high pressure (HP) turbine portion operatively coupled to an intermediate pressure (IP) turbine portion that, in turn, is coupled to a low pressure (LP) turbine. Similar to the expansion turbine of the gas turbine system, the various steam turbine portions are used to drive an external component such as a generator. In a typical combined cycle power plant, exhaust gas from the expansion turbine is passed to a heat recovery steam generator (HRSG), which may be used to reheat and provide steam to the various turbines portions of the steam turbine system for enhanced efficiency. Exhaust gas from the heat recovery steam generator may be released to the atmosphere through a stack.

During operation of the power system, certain components may experience high stress and thermal fatigue due to a rapid temperature change. For example, when the power system undergoes a start-up procedure, the heat recovery steam generator may immediately begin to generate high temperature steam. This high temperature steam may be provided to the various components such as a boiler of the heat recovery steam generator and then to outlet components such as the steam headers and the steam outlet manifold, which vents steam to atmosphere. Until the system reaches an equilibrium condition, there is the potential of misalignment of the connected outlet components, because some components are exposed to high temperature steam while other components are at ambient temperature.

Another issue with the steam outlet manifold is steam blowback. Steam blowback is a phenomenon that may occur when steam is initially ejected into a downstream pipe and creates a plume of steam behind the steam inlet. Existing designs for the drip pan of a steam discharge pipe were insufficient to prevent such steam blowback from the steam manifold. Such escaping steam may be a danger to those nearby.

SUMMARY

The present application and the resultant patent thus provide a steam discharge pipe blowback protection system for use with a steam discharge pipe and a flow of steam therethrough. The steam discharge pipe blowback protection system may include a vent stack pipe and a drip pan with an exit end of the steam discharge pipe extending through the drip pan and into the vent stack pipe. The drip pan includes a slide plate positioned around the steam discharge pipe such that a blowback in the flow of steam causes the slide plate to seal the drip pan.

The present application and the resultant patent further provide a method of flowing steam from a steam discharge pipe through a drip pan and into a vent stack pipe. The method may include the steps of initiating a flow of steam through the steam discharge pipe, receiving a blowback of steam from the steam discharge pipe into the drip pan such that the blowback of steam creates a positive pressure inside the drip pan and forces a slide plate to seal the drip pan, flowing an additional flow of steam into the vent stack pipe to achieve a steady state such that the additional flow of steam creates a negative pressure inside the drip pan and forces the slide plate to open the drip pan, and flowing ambient air into the flow of steam in the vent stack pipe.

The present application and the resultant patent further provide a heat recovery steam generator with a flow of steam therethrough. The heat recovery steam generator may include a steam discharge pipe to vent the flow of steam, a vent stack pipe to receive the flow of steam from the steam discharge pipe, and a drip pan surrounding the steam discharge pipe and the vent stack pipe. The drip pan includes a slide plate positioned around the steam discharge pipe such that a blowback in the flow of steam causes the slide plate to seal the drip pan.

These and other features and improvements of this application and the resultant patent will become apparent to one of ordinary skill in the art upon review of the following detailed description when taken in conjunction with the several drawings and the appended claims.

DETAILED DESCRIPTION

Figure 1:
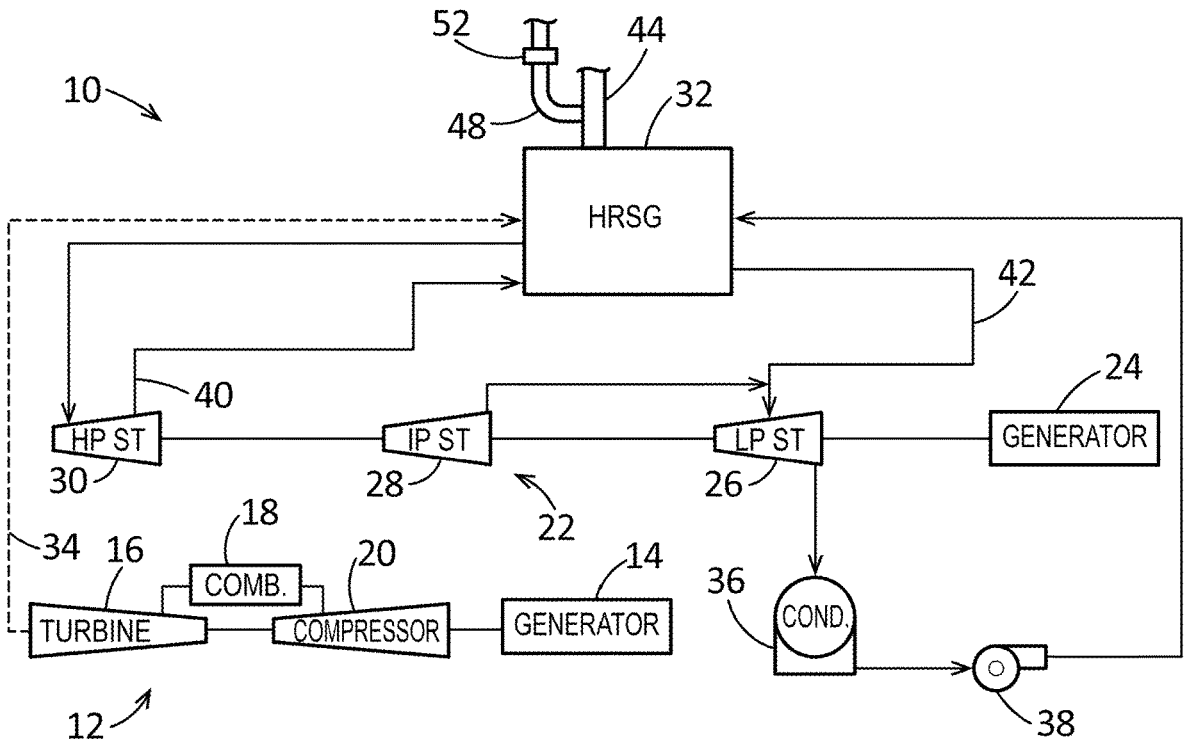
FIG. 1 is a schematic diagram of an exemplary gas turbine combined cycle power system, including a gas turbine, a steam turbine, and a heat recovery steam generator.

Referring now to the drawings, in which like numerals refer to like elements throughout the several views, FIG. 1 is a schematic diagram of an exemplary embodiment of a combined cycle power generation system 10. The combined cycle power generation system 10 may include a gas turbine system, a steam turbine system, and a heat recovery steam generator (HRSG). Specifically, the combined cycle system 10 may include a gas turbine system 12 for driving a first generator 14 to produce electrical power. The gas turbine system 12 may include a turbine 16 (e.g., an expansion turbine), a combustor 18, and a compressor 20. The combined cycle system 10 also may include a steam turbine system 22 for driving a second generator 24. The steam turbine system 22 may include a low-pressure section 26

(LP ST), an intermediate-pressure section 28 (IP ST), and a high-pressure section 30 (HP ST). Although the gas turbine system 12 and the steam turbine system 22 may drive separate generators 14 and 24 as is shown herein, the gas turbine system 12 and the steam turbine system 22 also may be utilized in tandem to drive a single load via a single shaft. The generators and components described herein and the like may be incorporated into other types of power generation systems.

The combined cycle system 10 also may include a multi-stage heat recovery steam generator 32. Heated exhaust gas from the gas turbine system 12 may be directed into the heat recovery steam generator 32 to heat the steam used to power the steam turbine system 22. Specifically, the heat recovery steam generator 32 may be fluidly connected and/or coupled with the turbine 16 via an exhaust channel 34 to provide exhaust fluid gases to the heat recovery steam generator 32 to be utilized in generating and/or heating steam therein. Likewise, the heat recovery steam generator 32 may be fluidly connected and/or coupled with the sections of the steam turbine system 22 via one or more exhaust conduit(s) 40 to receive steam as well as one or more supply conduits 42 to provide steam to sections of the steam turbine system 22.

Exhaust from the low-pressure section 26 of the steam turbine 22 may be directed into a condenser 36. Condensate from the condenser 36 may, in turn, be directed into a low-pressure section of the heat recovery steam generator 32 with the aid of a condensate pump 38. One or more exhaust stacks 44 of the heat recovery steam generator 32 may exhaust or release gas and/or fluid from heat recovery steam generator 32 into the atmosphere. Other components and other configurations may be used herein.

Figure 2:
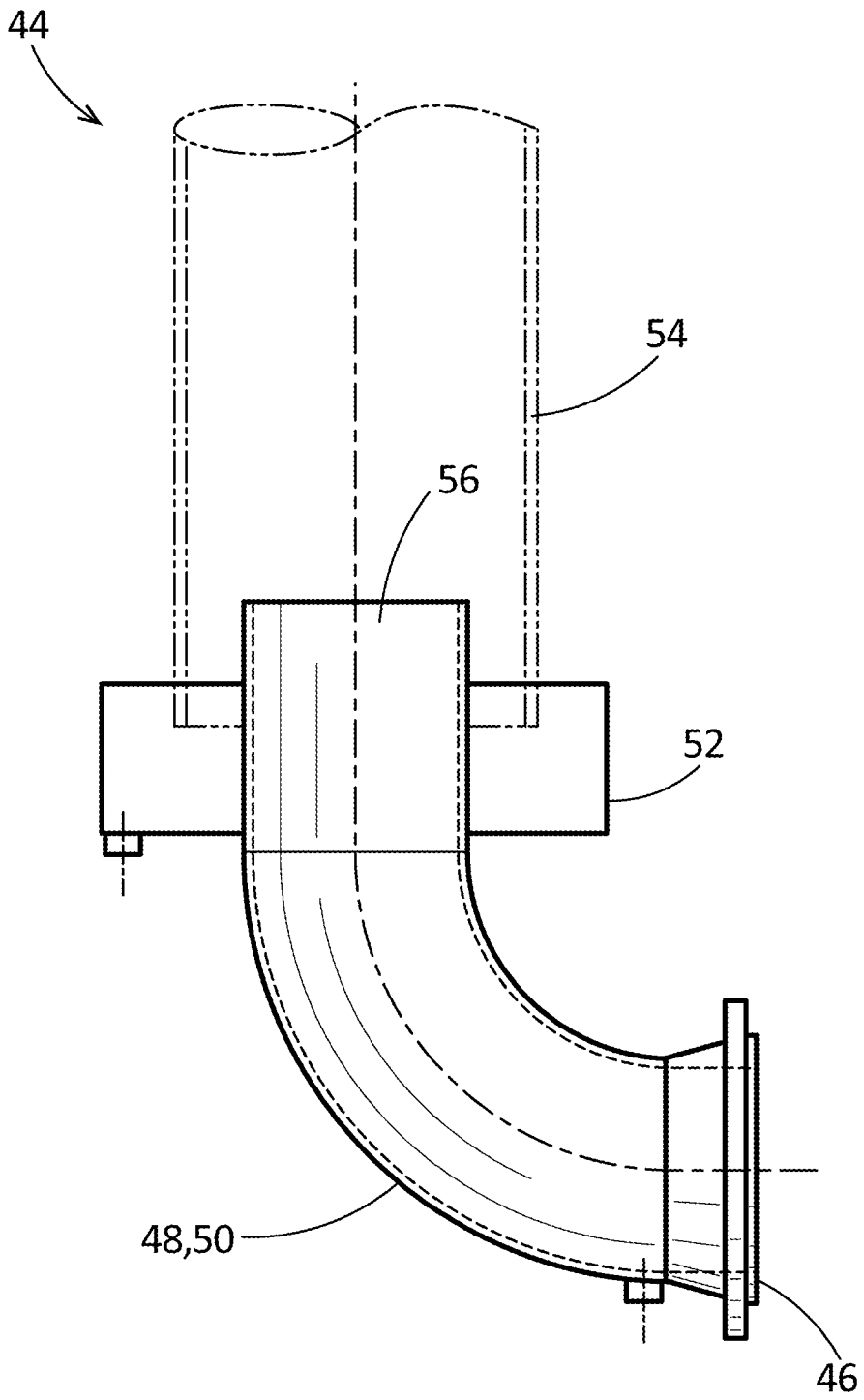
PRIOR ART FIG. 2
FIG. 2 is a schematic diagram of a known vent stack pipe and drip pan of a steam discharge pipe.

FIG. 2 shows an example of a portion of a known exhaust stack 44. The exhaust stack 44 may include a safety valve 46 attached to a steam discharge pipe 48. The steam discharge pipe 48 may have an elbow configuration 50. One end of the steam discharge pipe 48 may be attached to the safety valve 46 and the other end may extend into a drip pan 52 and a vent stack pipe 54. Specifically, an exit end 56 of the steam discharge pipe 48 may extend through the drip pan 52 and into the vent stack pipe 54. As shown, the diameter of the steam discharge pipe 48 is smaller than the diameter of the vent stack pipe 54, which has a diameter that is smaller than the diameter of the drip pan 52.

As described above, steam may be vented into the exhaust stack 44 during, for example, start-up procedures. The high temperature of the steam may cause a thermal mismatch between the high temperature components and the ambient temperature components until an equilibrium is reached. Moreover, a blowback of steam may allow the steam to escape between the drip pan 52 and the vent stack pipe 54 when exiting the steam discharge pipe 48 instead of being vented directly into the vent stack pipe 54. Specifically, the steam may flow through the steam discharge pipe 48 into the vent stack pipe 54, where the steam reverses flow into the drip pan 52. Because the drip pan 52 is open at the top, this blowback of steam may create a hazardous situation for those nearby.

Figure 3:
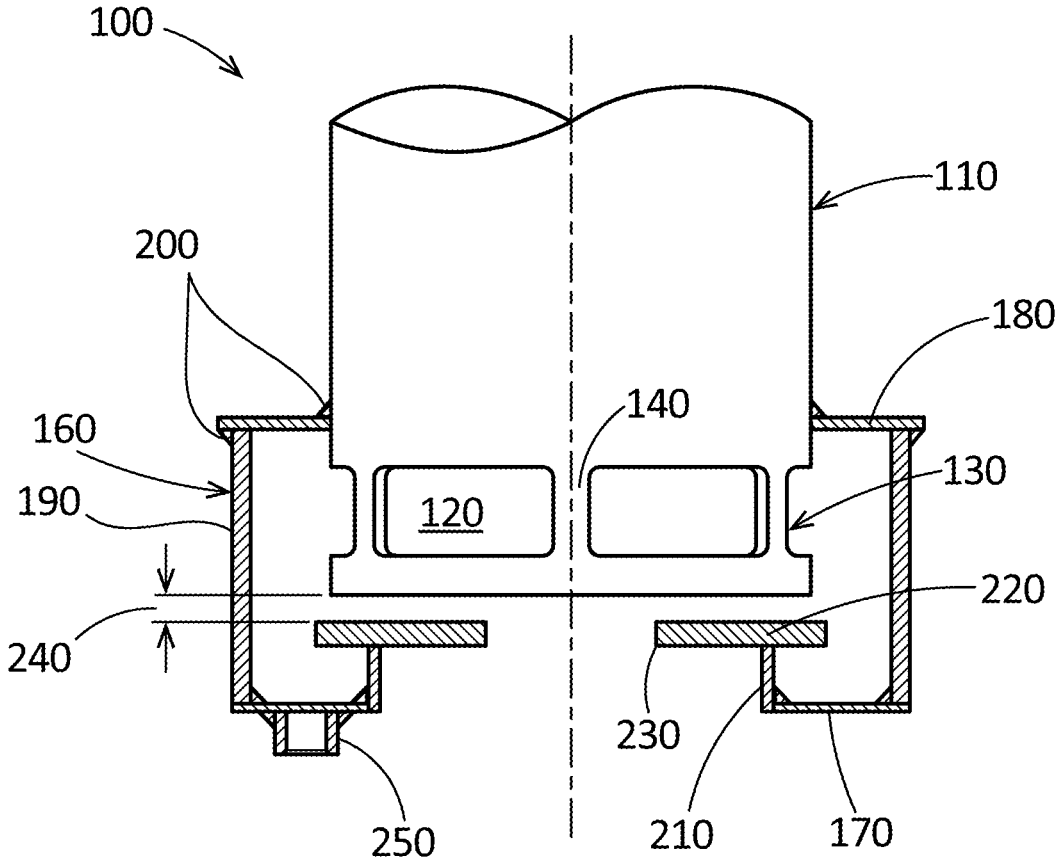
FIG. 3 is a partial sectional view of a steam discharge pipe blowback protection system as may be described herein.
Figure 4:
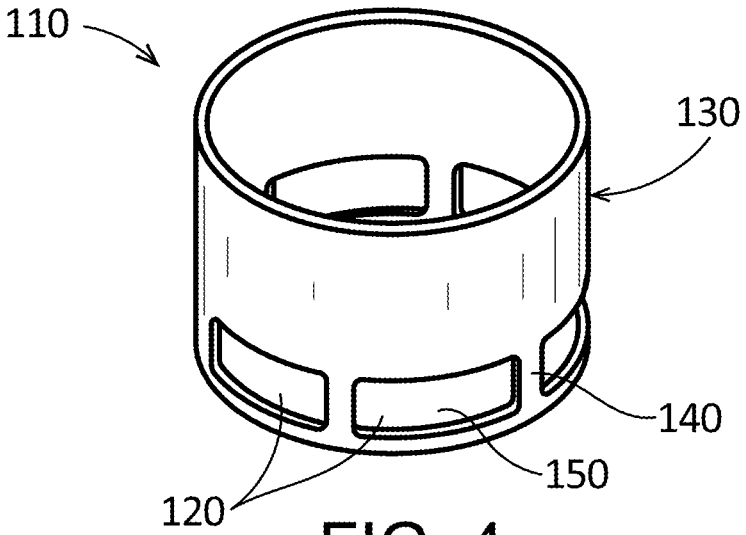
FIG. 4 is a perspective view of a lower end of a vent stack pipe that may be used with the steam discharge pipe blowback protection system of FIG. 3.

FIGS. 3 and 4 show a steam discharge pipe blowback protection system 100 as may be described herein. The steam discharge pipe blowback protection system 100 may be used with the steam discharge pipe 48 as described above or any source of a heated fluid. The steam discharge pipe blowback protection system 100 may include a vent stack pipe 110. The exit end 56 of the steam discharge pipe 48 extends into the vent stack pipe 110. As described above, the diameter of the steam discharge pipe 48 is smaller than the diameter of the vent stack pipe 110, and the diameter of the vent stack pipe 110 is smaller than the diameter of a drip pan 160, as discussed below.

In this example, the vent stack pipe 110 may include a number of apertures 120 at a lower end 130 thereof. The apertures 120 may be defined between a number of fillets 140. The apertures 120 may be largely rectangular 150 in shape and uniformly shaped, although any shape, any number, and any spacing may be used. The apertures 120 may be formed in the lower end 130 of the vent stack pipe 110, or the lower end 130 may be a separate element that is joined to the vent stack pipe 110. The apertures 120 on the lower end 130 of the vent stack pipe 110 are positioned inward of, or below, a top end wall 180 of the drip pan 160, such that the apertures 120 are in fluid communication with the interior of the drip pan 160. As shown in FIG. 3, the end of the steam discharge pipe 48 extends beyond (above) the apertures 120.

The drip pan 160 may be positioned between the steam discharge pipe 48 and the vent stack pipe 110. The drip pan 160 may have a bottom or first end wall 170 positioned about and radially outward from, the steam discharge pipe 48, a top or second end wall 180 positioned about and joined to the vent stack pipe 110, and a sidewall 190 extending between the two end walls 170, 180. The respective walls 170, 180, 190 may be connected via a number of welds 200 or other types of permanent connection means. The bottom or the first end wall 170 may have a support ledge 210 extending vertically therein (and parallel to the sidewall 190), which surrounds and is spaced apart from the steam discharge pipe 48. A slide plate 220 may be positioned on the support ledge 210. The slide plate 220 may have a central aperture 230 sized for the diameter of the steam discharge pipe 48. The slide plate 220 has a diameter less than the diameter of the drip pan 160 but greater than the diameter of the vent stack pipe 110, such that the slide plate 220 is not capable of being sucked into the vent stack pipe 110 during operation. The slide plate 220 may be maneuverable up and down the steam discharge pipe 48 within confines of the walls 170, 180, 190 of the drip pan 160. When the slide plate 220 is positioned on the support ledge 210, the slide plate 220 and the lower end 130 of the vent stack pipe 54 may be separated by a predetermined clearance distance 240.

The bottom or the first wall 170 of the drip pan 160 may include a drain 250 formed therein. The top or the second end wall 180 may be welded or otherwise fixedly attached to the vent stack pipe 110. Other components and other configurations may be used herein.

Figure 5:
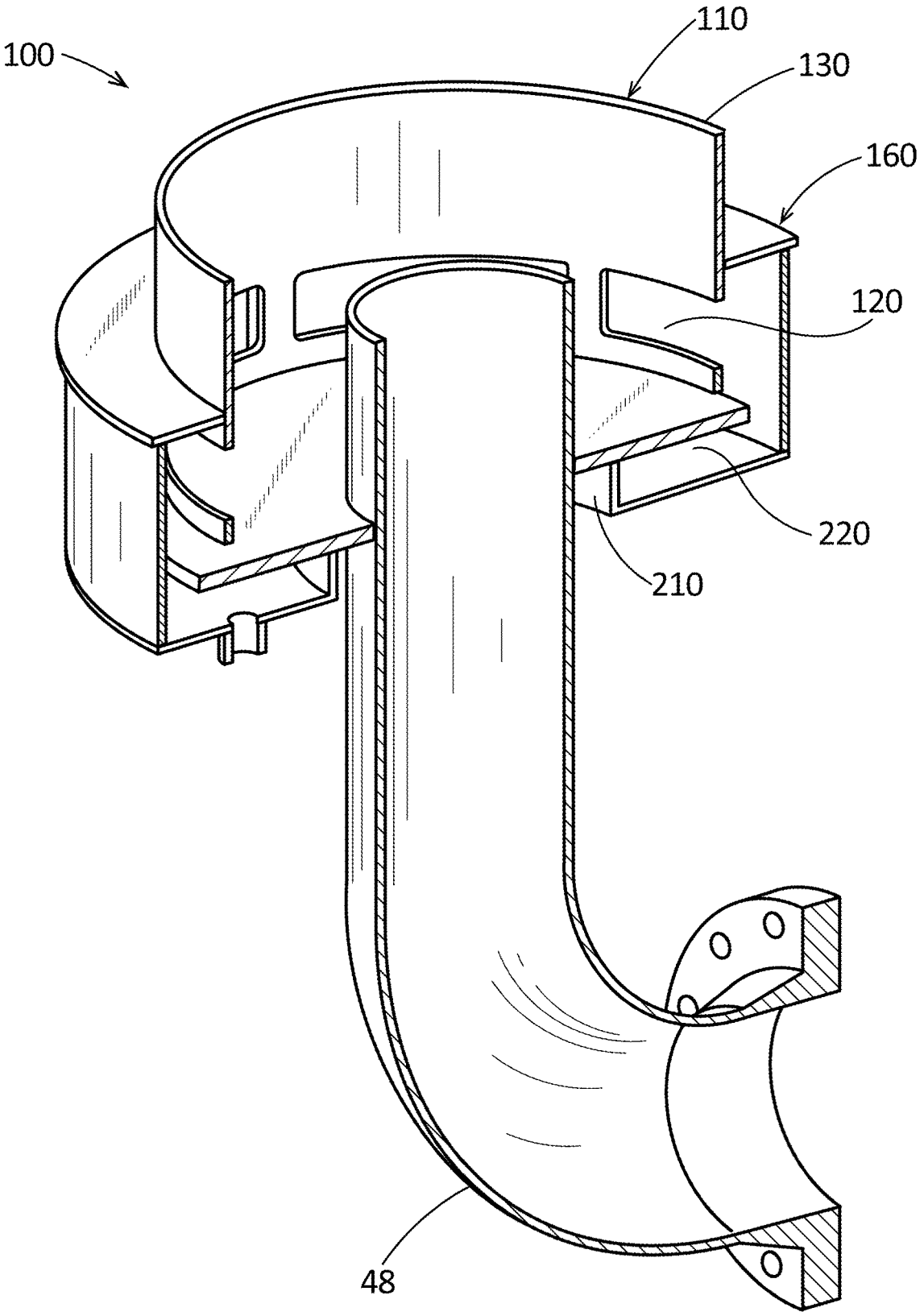
FIG. 5 is a partial sectional view of the steam discharge pipe blowback system of FIG. 3 with a slide plate in a closed or lowered position.
Figure 6:
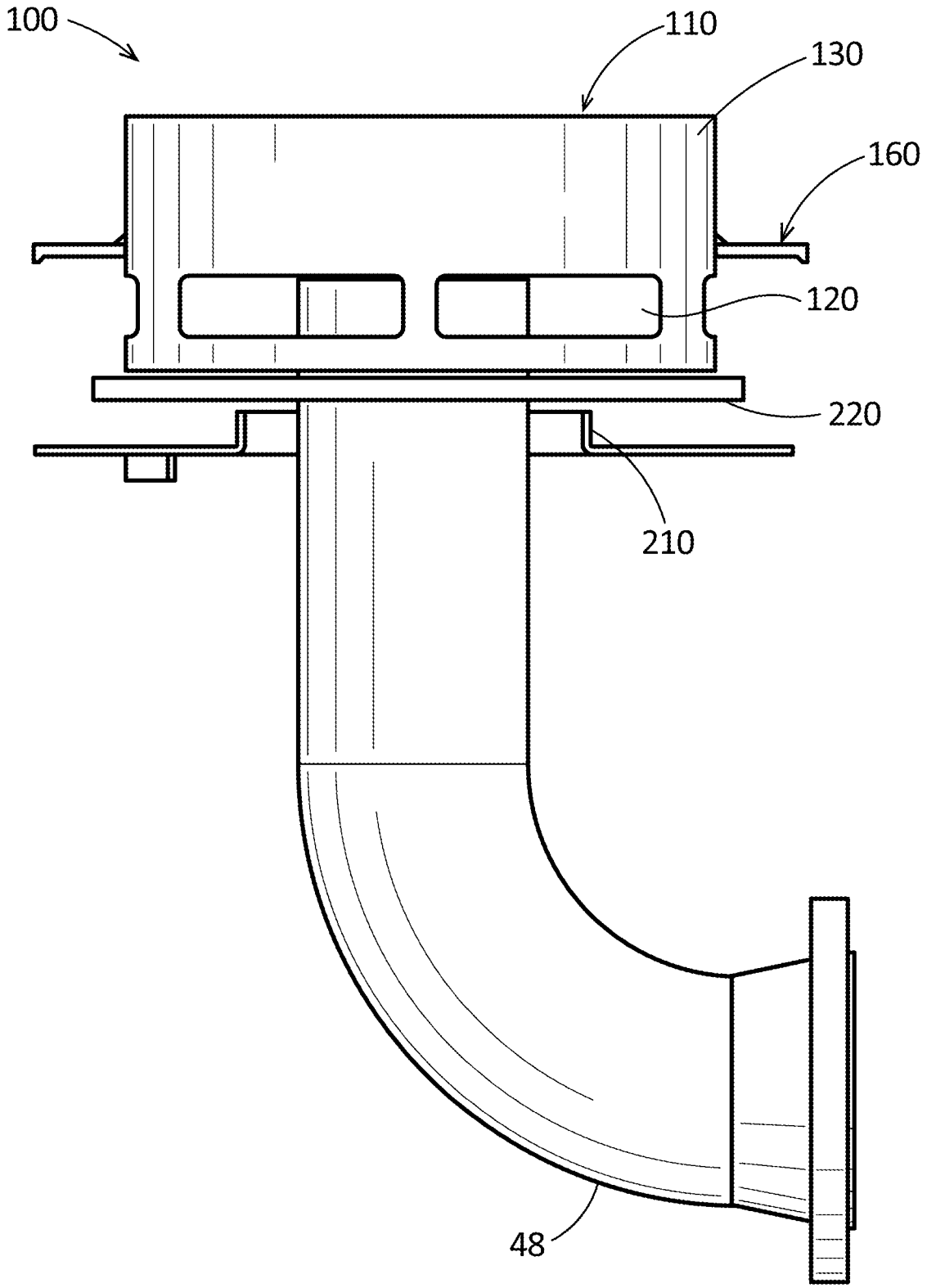
FIG. 6 is a side plan view of the steam discharge pipe blowback system of FIG. 3 with the slide plate in an open or raised position.

FIGS. 5 and 6 show the steam discharge pipe blowback protection system 100 in operation. Once steam begins to flow into the steam discharge pipe 48, there may be some eccentricity as the steam discharge pipe 48, the vent stack pipe 110, and other components thermally expand until an equilibrium point is reached. Further, there may be some steam blowback. Specifically, the flow of steam may extend into the lower end 130 of the vent stack pipe 110 and may circulate turbulently through the apertures 120 therein and into plenum defined by the drip pan 160. This turbulent flow causes a positive (i.e., greater than atmospheric) in pressure that will force the slide plate 220 downward against the support ledge 210 on the first wall 170 as is shown in FIGS. 3 and 5. This position effectively seals the drip pan 160 and prevents the flow of steam from escaping therefrom.

After the blowback, a normal or laminar flow of steam may extend through the vent stack pipe 110. As an equilibrium (steady state) condition is reached, this normal flow will decrease the pressure within the drip pan 160 below atmospheric pressure (i.e., to a negative pressure). The reduction in pressure will allow the slide plate 220 to be drawn off the support ledge 210 along the steam discharge pipe 48 as is shown in FIG. 6. A flow of ambient air then may be forced into the drip pan 160 and may be entrained into the flow of steam. Specifically, air flows between the steam discharge pipe 48 and the support ledge 210 into the gap between the raised slide plate 220 and the top of the support ledge 210 and into the plenum defined by the wall 170, 180, 190 of the drip pan 160. Air can enter the vent stack pipe 110 via the apertures 120 in the lower end 130 thereof and become entrained with the steam flow. The entrained air flow provides a layer of film along the interior of the vent stack pipe 110 and ensures that shock waves within the flow of steam are buffered from the wall of the vent stack pipe 110.

The steam discharge pipe blowback protection system 100 thus helps alleviate the complex connections of the components in the exhaust stack 44 by allowing for position mismatch. Likewise, the steam discharge pipe blowback protection system 100 protects against steam blowback escaping therefrom. Further, after this moment of blowback, the steam discharge pipe blowback protection system 100 then allow air to be entrained into the flow of steam for overall stable operation.

It should be apparent that the foregoing relates only to certain embodiments of this application and resultant patent. Numerous changes and modifications may be made herein by one of ordinary skill in the art without departing from the general spirit and scope of the disclosure as defined by the following claims and the equivalents thereof.

Further aspects of the present steam discharge pipe blowback protection system are provided by the subject matter of the following clauses:

1. A steam discharge pipe blowback protection system for use with a steam discharge pipe and a flow of steam therethrough, comprising a vent stack pipe and a drip pan, wherein an exit end of the steam discharge pipe extends through the drip pan and into the vent stack pipe, wherein the drip pan comprises a slide plate positioned around the steam discharge pipe, and wherein a blowback in the flow of steam causes the slide plate to seal the drip pan.

2. The steam discharge pipe blowback protection system of any preceding clause, wherein, after the blowback in the flow of steam, the slide plate is configured to rise along the steam discharge pipe and allow a flow of ambient air into the drip pan.

3. The steam discharge pipe blowback protection system of any preceding clause, wherein the vent stack pipe comprises a plurality of apertures positioned in a lower end thereof.

4. The steam discharge pipe blowback protection system of any preceding clause, wherein the plurality of apertures of the vent stack pipe are positioned within the drip pan.

5. The steam discharge pipe blowback protection system of any preceding clause, wherein each aperture of the plurality of apertures of the vent stack pipe comprises a rectangular shape.

6. The steam discharge pipe blowback protection system of any preceding clause, wherein the plurality of apertures of the vent stack pipe are separated by a plurality of fillets.

7. The steam discharge pipe blowback protection system of any preceding clause, wherein the vent stack pipe and the drip pan are welded together.

8. The steam discharge pipe blowback protection system of any preceding clause, wherein the drip pan comprises a first end wall, a second end wall opposite the first end wall, and a sidewall connecting the first end wall and the second end wall.

9. The steam discharge pipe blowback protection system of any preceding clause, wherein the first wall comprises a support ledge configured to support the slide plate.

10. The steam discharge pipe blowback protection system of any preceding clause, wherein the first end wall comprises a drain therein.

11. The steam discharge pipe blowback protection system of any preceding clause, wherein the first end wall, the second end wall, the sidewall, and the support ledge are welded together.

12. The steam discharge pipe blowback protection system of any preceding clause, wherein the slide plate comprises a central aperture sized to accommodate the steam discharge pipe.

13. The steam discharge pipe blowback protection system of any preceding clause, wherein aperture sized to accommodate the steam discharge pipe. the vent stack pipe and the slide plate are separated by a predetermined clearance distance.

14. A method of flowing steam from a steam discharge pipe through a drip pan and into a vent stack pipe, the method comprising: initiating a flow of steam through the steam discharge pipe; receiving a blowback of steam from the steam discharge pipe into the drip pan, wherein the blowback of steam creates a positive pressure inside the drip pan and forces a slide plate to seal the drip pan; flowing an additional flow of steam into the vent stack pipe to achieve a steady state, wherein the additional flow of steam creates a negative pressure inside the drip pan and forces the slide plate to open the drip pan; and flowing ambient air into the flow of steam in the vent stack pipe.

15. A heat recovery steam generator with a flow of steam therethrough, comprising a steam discharge pipe to vent the flow of steam, a vent stack pipe to receive the flow of steam from the steam discharge pipe, and a drip pan surrounding the steam discharge pipe and the vent stack pipe, wherein the drip pan comprises a slide plate positioned around the steam discharge pipe, and wherein a blowback in the flow of steam causes the slide plate to seal the drip pan.

16. The heat recovery steam generator of any preceding clause, wherein, after the blowback in the flow of steam, the slide plate is configured to rise along the steam discharge pipe and allow a flow of ambient air into the drip pan.

17. The heat recovery steam generator of any preceding clause, wherein the vent stack pipe comprises a plurality of apertures positioned in a lower end thereof within the drip pan.

18. The heat recovery steam generator of any preceding clause, wherein the drip pan comprises a first end wall, a second end wall opposite the first end wall, and a sidewall connecting the first end wall and the second end wall; and wherein the first end wall comprises a support ledge configured to support the slide plate.

19. The heat recovery steam generator of any preceding clause, wherein the slide plate comprises a central aperture and wherein the central aperture of the slide plate is sized to accommodate the steam discharge pipe.

We claim:

1. A steam discharge pipe blowback protection system for use with a steam discharge pipe and a flow of steam therethrough, comprising:

a vent stack pipe;

wherein the vent stack pipe comprises a plurality of apertures positioned in a lower end thereof; and a drip pan;

wherein an exit end of the steam discharge pipe extends through the drip pan and into the vent stack pipe;

wherein the drip pan comprises a slide plate positioned around the steam discharge pipe; and wherein a blowback in the flow of steam causes the slide plate to seal the drip pan.

2. The steam discharge pipe blowback protection system of claim 1, wherein, after the blowback in the flow of steam, the slide plate is configured to rise along the steam discharge pipe and allow a flow of ambient air into the drip pan.

3. The steam discharge pipe blowback protection system of claim 1, wherein the plurality of apertures of the vent stack pipe are positioned within the drip pan.

4. The steam discharge pipe blowback protection system of claim 1, wherein each aperture of the plurality of apertures of the vent stack pipe comprises a rectangular shape.

5. The steam discharge pipe blowback protection system of claim 1, wherein the plurality of apertures of the vent stack pipe are separated by a plurality of fillets.

6. The steam discharge pipe blowback protection system of claim 1, wherein the vent stack pipe and the drip pan are welded together.

7. The steam discharge pipe blowback protection system of claim 1, wherein the drip pan comprises a first end wall, a second end wall opposite the first end wall, and a sidewall connecting the first end wall and the second end wall.

8. The steam discharge pipe blowback protection system of claim 7, wherein the first wall comprises a support ledge configured to support the slide plate.

9. The steam discharge pipe blowback protection system of claim 7, wherein the first end wall comprises a drain therein.

10. The steam discharge pipe blowback protection system of claim 8, wherein the first end wall, the second end wall, the sidewall, and the support ledge are welded together.

11. The steam discharge pipe blowback protection system of claim 1, wherein the slide plate comprises a central aperture sized to accommodate the steam discharge pipe.

12. The steam discharge pipe blowback protection system of claim 1, wherein, when the blowback in the flow of steam is not occurring, the vent stack pipe and the slide plate are separated by a predetermined clearance distance.

13. A method of flowing steam from a steam discharge pipe through a drip pan and into a vent stack pipe, comprising:

initiating a flow of steam through the steam discharge pipe;

receiving a blowback of steam from the steam discharge pipe into the drip pan, wherein the blowback of steam creates a positive pressure inside the drip pan and forces a slide plate to seal the drip pan;

flowing an additional flow of steam into the vent stack pipe to achieve a steady state, wherein the additional flow of steam creates a negative pressure inside the drip pan and forces the slide plate to open the drip pan; and flowing ambient air into the flow of steam in the vent stack pipe.

14. A heat recovery steam generator with a flow of steam therethrough, comprising:

a steam discharge pipe to vent the flow of steam;

a vent stack pipe to receive the flow of steam from the steam discharge pipe;

wherein the vent stack pipe comprises a plurality of apertures positioned in a lower end thereof within the drip pan; and a drip pan surrounding the steam discharge pipe and the vent stack pipe;

wherein the drip pan comprises a slide plate positioned around the steam discharge pipe; and wherein a blowback in the flow of steam causes the slide plate to seal the drip pan.

15. The heat recovery steam generator of claim 14, wherein, after the blowback in the flow of steam occurs, the slide plate is configured to rise along the steam discharge pipe and allow a flow of ambient air into the drip pan.

16. The heat recovery steam generator of claim 14, wherein the drip pan comprises a first end wall, a second end wall opposite the first end wall, and a sidewall connecting the first end wall and the second end wall, and wherein the first end wall comprises a support ledge configured to support the slide plate.

17. The heat recovery steam generator of claim 14, wherein the slide plate comprises a central aperture sized to accommodate the steam discharge pipe.

* * * * *